United States Patent [19]

Ishitani et al.

[11] Patent Number: 4,900,974

[45] Date of Patent: Feb. 13, 1990

[54] ION SOURCE

[75] Inventors: Tohru Ishitani, Sayama; Hideo Todokoro, Tokyo; Hifumi Tamura, Hachioji, all of Japan

[73] Assignee: Hitachi, Ltd., Tokyo, Japan

[21] Appl. No.: 668,932

[22] Filed: Nov. 7, 1984

Related U.S. Application Data

[63] Continuation of Ser. No. 533,745, Sep. 19, 1983, abandoned, which is a continuation of Ser. No. 231,334, Feb. 4, 1981, abandoned.

[30] Foreign Application Priority Data

Feb. 8, 1980 [JP] Japan ..... 55-13724

[51] Int. Cl.[4] ..... H01J 1/02

[52] U.S. Cl. ..... 313/359.1

[58] Field of Search ..... 313/230, 336, 328, 362.1, 313/232, 163, 359.1

[56] References Cited

U.S. PATENT DOCUMENTS 3,814,975 6/1974 Wolfe et al. ..... 313/336

4,088,919 5/1978 Clampitt et al. ..... 313/336 X

*Primary Examiner*—Donald J. Yusko

*Assistant Examiner*—Sandra L. O'Shea

*Attorney, Agent, or Firm*—Antonelli, Terry & Wands

[57] ABSTRACT

An EHD ion source includes an extractor and a control electrode with extractor being disposed below a tip of an electrode, and functioning to apply an electric field to a substance to-be-ionized wetting a pointed end of the tip, so as to derive ions from the pointed tip end. The control electrode is disposed in the vicinity of the pointed end of the tip, and it functions to apply an electric field to the substance to-be-ionized in its molten state so as to supply the pointed tip end with the substance to-be-ionized in a suitable amount. As a result, a great ion current which is substantially proportional to an extracting voltage can be derived from the pointed tip end.

6 Claims, 5 Drawing Sheets

ION SOURCE

This is a continuation of application Ser. No. 533,745 filed September 19, 1983, which was a continuation of Ser. No. 236,339 filed Feb. 4, 1981, both abandoned.

FIELD OF THE INVENTION

The present invention relates to an improved ion source for use in for example an ion microanalyzer (IMA), an ion implanter, an ion beam patterning apparatus, a dry etching apparatus, etc.

BACKGROUND OF THE INVENTION

The microminiaturization of an ion beam is required for enhancing performances in the fields of the dry microprocess such as for example ion beam lithography, dry development, and micro-doping, and submicron surface analysis such as, for example three-dimensional analysis including also the depth direction), etc. therefore considerable activity has been devoted to developing a point ion-source of high brightness.

To the end of the microminiaturization of an ion beam, it is desirable to develop an ion source which has to properties of high brightness, small effective source-size, high angular intensity, and narrow energy width. An ion source which nearly satisfies the noted properties, is an electrohydrodynamic or "EHD" ion source.

An EHD ion source of the aforementioned type is described in detail in U.S. Pat. No. 4,088,919. The fundamental principle of the EHD ion source is based on the phenomenon that, when an intense electric field of $10^6$–$10^8$ V/cm is applied to a pointed end of an electrode formed as of a pipe having an inside diameter of approximately 100 μm filled a liquefied metal or a conductive liquid or a needle shaped electrode having a pointed end a radius of curvature of below several μm, wetted with a liquefied metal, ions of the liquid component are emitted therefrom. The mechanism of the ionization is not yet fully understood.

FIG. 1 shows the fundamental construction of a prior-art EHD ion source of the needle type and according to this figure, an electrode generally designated by the reference numeral 10 provided with a tip 2 having a pointed end with a radius of curvature of below approximately 10 μm, is spot-welded to the central part of a hairpin-shaped filament 1. A central part 8 of the filament 1 carries a liquefied metal 3, for example, Ga. A high voltage $V_1$ is applied between an extractor 4, provided with an aperture 9 and disposed below the tip 2 and the electrode 10, by an extracting power supply 6 so as to give the extractor 4 a negative potential and to establish an electric field of $10^6$–$10^8$ V/cm at the pointed end of the tip 2. Then, ions 5 of the component of the liquefied metal 3 are emitted from the pointed end of the tip 2 wetted with the liquefied metal 3. This is the operating principle of the EHD ion source. A voltage $V_o$ applied across both the ends of the filament 1 is a voltage for heating the filament 1 in order to keep the liquefied metal 3 in the liquefied state, and it is supplied by a heating power supply 7.

FIGS. 2A–2D illustrate the manner in which the surface profile of the liquefied metal 3 carried on the central part 8 of the electrode 10 varies depending upon the magnitude of the extracting voltage $V_1$. More particularly, as shown in FIG. 2A, the liquefied metal 3 is not carried by the electrode 10; however, in FIG. 2B the liquefied metal 3 is carried by the electrode 10, but the extracting voltage $V_1$ is null. As apparent from FIG. 2B, when the extracting voltage $V_1$ is null, the surface profile of the liquefied metal 3 extends substantially along the shape of the electrode 10. When the extracting voltage $V_1$ is gradually increased to 10 kV, the surface profile of the liquefied metal 3 is altered to the profile shown in FIG. 2C. As shown in FIG. 2C, under the action of the electric field, the surface profile of the liquefied metal 3 is somewhat expanded from the shape of the electrode 10. When the extracting voltage $V_1$ is further increased to 13.5 kV, the surface profile of the liquefied metal 3 assumes the profile shown in FIG. 2D, wherein is greatly expanded from the shape of the electrode 10. In an experiment, when the extracting voltage $V_1$ was increased to 14 kV, the liquefied metal 3 could not endure the action of the great electric field and for the most part, dropped from the electrode 10. A experiment was conducted by employing a flat electrode as the extractor 4 and setting the distance between the pointed end of the tip 2 and the extractor 4 at 10 mm.

FIG. 3 is a graph showing the relationship in the above experiment between the extracting voltage $V_1$ and the ion current $I_T$ obtained at that time. The ion current $I_T$ was measured with the extractor having no aperture 9 and by means of an ammeter disposed between the extractor 4 and ground. As apparent from FIG. 3, the electric field of the pointed end of the tip 2 increases with the increase of the extracting voltage $V_1$. At a point in time when a certain threshold value $V_{t1}$ (approximately 6.4 kV) is exceeded, the ion beam 5 of the liquefied metal 3 begins to be emitted from the pointed end of the tip 2. The electric field is established to be the most intense at the pointed end of the tip 2. Since, however, the elecric field is formed also in the other surface parts of the liquefied metal 3, the liquefied metal 3 itself is drawn in the direction of the electric field. When the field intensity is too high, not only is the liquid profile of the liquefied metal 3 changed from the previous conical shape into the flat shape as shown in FIG. 2D, but also the quantity of supply of the liquefied metal 3 towards the pointed end of the tip 2 becomes large. Regarding the quantity of the liquefied metal 3 at the pointed end of the tip 2, it is ideal that the quantity to be emitted as the ions 5 balances with the quantity to be supplied from the root part of the tip 2 to the pointed end thereof. If the quantity supplied to the pointed end of the tip 2 is larger than the quantity emitted in the form of the ions 5 from the pointed end of the tip 2, the quantity of the liquefied metal 3 at the pointed end of the tip 2 becomes excessive. Therefore, the radius of curvature of the pointed end of the tip 2 becomes large, and the intensity of the electric field established at the pointed end of the tip 2 lowers. As a result, as seen from the graph of FIG. 3, while the extracting voltage $V_1$ is in a low voltage range, the ion current $I_T$ tends to increase with the increase of the extracting voltage $V_1$, whereas, when the extracting voltage $V_1$ exceeds a certain value, the ion current $I_T$ tends to abruptly decrease in spite of the increase of the extracting voltage $V_1$.

That is, with the construction of the prior-art EHD ion source shown in FIG. 1, the control of the magnitude of the ion current $I_T$ is made by the increase or decrease of the extracting voltage $V_1$. Therefore, when it is intended to obtain a great ion current $I_T$ by applying a great extracting voltage $V_1$, the electric field rather weakens due to the change of the shape of the pointed end of the tip 2, so that even when a voltage in excess of a certain specific value is applied a greater ion current cannot be generated. This leads to the problem that there is the limitation to the magnitude of the ion current $I_T$ which can be derived.

BRIEF DESCRIPTION OF THE INVENTION

It is accordingly an object of this invention to provide an ion source of high performance which can generate a great ion current without being limited by an extracting voltage.

In order to accomplish the object, according to this invention, an ion source is constructed in such a manner that a control electrode, which applies an electric field to a substance to-be-ionized held in its molten state by a holding part of an electrode and serves to control the quantity of supply of the substance to-be-ionized to a pointed end part of a tip, is disposed in the vicinity of the pointed end part of the tip separately from an extractor which serves to extract ions of the substance from the pointed end of the tip.

Due to such a characterizing construction of an ion source, the intensity of an electric field for supplying the pointed end of the tip with the substance to-be-ionized held in its molten state by the holding part of the electrode and the intensity of an electric field for deriving the ions of the substance from the pointed end of the tip can be controlled by voltages applied to the control electrode and the extractor, respectively and substantially independently of each other. It has therefore become possible to readily obtain a great ion current with a great extracting voltage without incurring the inconvenience that the ion current decreases suddenly when the extracting voltage is made high.

DETAILED DESCRIPTION

Figure 4:
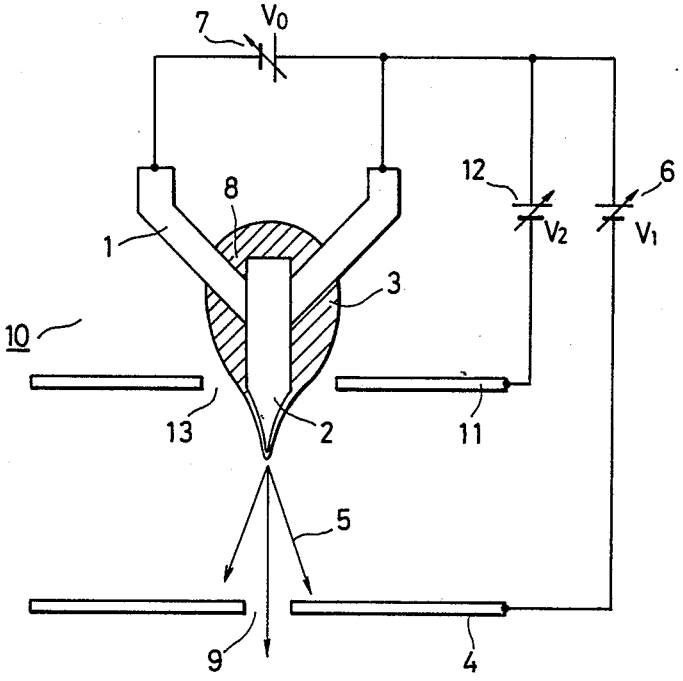
FIG. 4 is a schematic view of an EHD ion source constructed according to the present invention.

Referring now to the drawings wherein like reference numerals are used throughout the various views to designate like parts and, more particularly, to FIG. 4 according to this figure, an ion source includes hairpin shaped 1 filament formed for example of a tungsten wire having a diameter of 150 μm. A tip 2 is spot-welded to the central or holding part 8 of the filament 1. The tip 2 is made of a tungsten wire having a diameter as 120 μm, and its pointed end is worked by the etching process into the shape of a needle having a radius of curvature of approximately 1 μm. Shown be gallium metal (Ga) which presents a substantially liquid state at the normal temperature, and which is carried in a slight amount by the holding part or central part 8 of an electrode 10. Of course, before the Ga metal 3 is carried, the electrode 10 is surface treated to be clean by the flashing or the like. A heating power supply 7 which has a voltage $V_o$ for energizing the filament 1 to control the temperature of the filament 1 to a certain fixed point of for example, 200° C., and to control the viscosity of the Ga metal 3 held by the central or holding part 8. The extractor 4 is disposed below the tip 2 in order to extract a Ga ion beam 5 from the pointed end of the tip 2 wetted with the Ga metal 3, by virtue of an electric field. An extracting voltage $V_1$ for extracting the Ga ion beam 5 is applied between the extractor 4 and the electrode 10 by an extracting power supply 6 so that the extractor 4 may have a negative potential. The aperture 9 provided in the extractor 4 enables the Ga ion beam 5 to pass through the extractor 4 and The aperture a is located so that a center line of the tip 2 may pass through a center of the aperture 9. A control electrode 11 is disposed in the vicinity of the pointed end of the tip 2 in order to supply the Ga metal 3 carried by the holding part 8 of the electrode 10 to the pointed end of the tip 2 in a suitable amount by an electric field, and which constitutes an important feature of this invention. A control voltage $V_2$ for supplying the pointed end of the tip 2 with the Ga metal 3 in the suitable amount is applied between the control electrode 11 and the electrode 10 by a control power supply 12 so that the control electrode 11 may have a negative potential. The control electrode 11 has an aperture 13, and is arranged so that the center line of the tip 2 may pass through the center of the aperture 13.

In operation of the ion source of FIG. 4, the Ga metal 3, carried on the holding part 8 of the electrode 10, is heated to approximately 200° C. by the filament 1 heated by the heating voltage $V_o$. Then, when the control voltage $V_2$ is null, the Ga metal 3 wets the surface of the tip 2 in a manner to center around the root part of the tip 2. The extent of the wetting at this time is determined by the viscosity, surface tension, etc. of the Ga metal 3. At this time, however, the Ga metal 3 is not considered to sufficiently reach the vicinity of the pointed end of the tip 2 having the radius of curvature of approximately 1 μm. Now, when the control voltage $V_2$ is applied between the electrode 10 and the control electrode 11 by the control power supply 12, an electric field is established on the surface of the Ga metal 3.

This electric field acts to draw the Ga metal 3 towards the pointed end of the tip 2 along the surface of the tip 2.

Accordingly, the Ga metal 3 not having reached the vicinity of the pointed end of the tip 2 at the null control voltage $V_2$ reaches the vicinity of the pointed end of the tip 2 and can wet the pointed end upon the application of the control voltage $V_2$. By varying the magnitude of the control voltage $V_2$, it is possible to freely control the quantity in which the Ga metal 3 wets the pointed end of the tip 2, that is, the quantity of supply of the Ga metal 3 to the pointed end of the tip 2. When, under such state, the extracting voltage $V_1$ is applied between the extractor 4 and the electrode 10 by the extracting power supply 6, an intense electric field which is principally determined by the extracting voltage $V_1$ is established at the pointed end of the tip 2. This electric field acts on the surface of the Ga metal 3 and emits the Ga ion beam 5 of the Ga metal 3 from the pointed end of the tip 2.

These operations are carried out in an ion source chamber (not shown) whose pressure is maintained at approximately $10^{-7}$ Torr. The electric field established by the extracting voltage $V_1$ scarcely acts on the other part than the pointed end part of the tip 2. This is because the control electrode 11 functions to shield the Ga metal 3 in the other part than the pointed end of the tip 2 from the electric field intending to act thereon. Accordingly, the quantity of supply of the Ga metal 3 to the pointed end of the tip 2 can be controlled by the control voltage $V_2$, while the current value of the Ga ion beam 5 to be derived from the pointed end of the tip 2 can be principally controlled by the extracting voltage $V_1$. At this time, the control voltage $V_2$ slightly affects the current value of the Ga ion beam 5.

Figure 1:
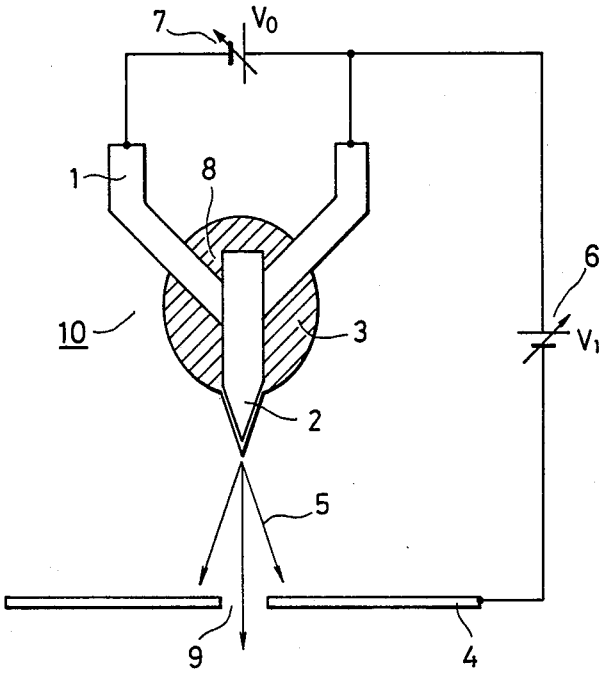
FIG. 1 PRIOR ART
FIG. 1 is a schematic view of a prior-art EHD ion source.
Figure 2A:
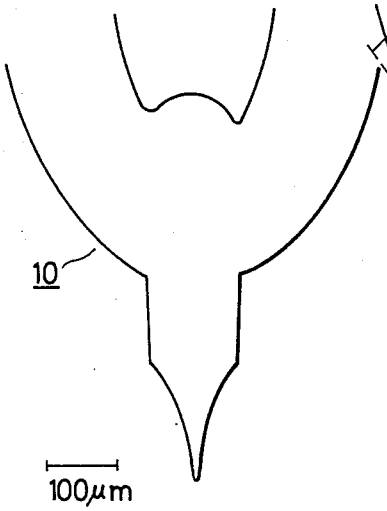
FIGS. 2A–2D are diagramatic illustrations, on an enlarged scale, of changes of the surface profile of a liquefied metal depending upon the magnitude of an extracting voltage, with the ion source of FIG. 1.
Figure 2B:
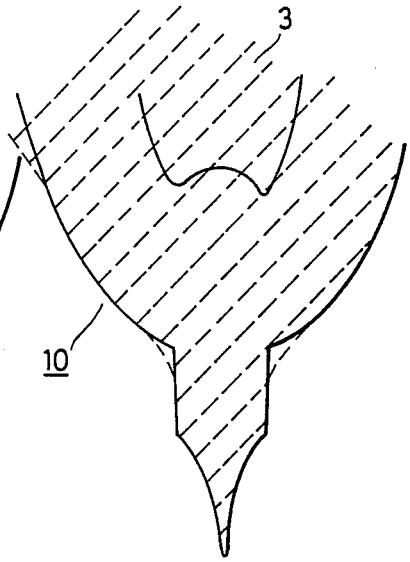
Figure 2C:
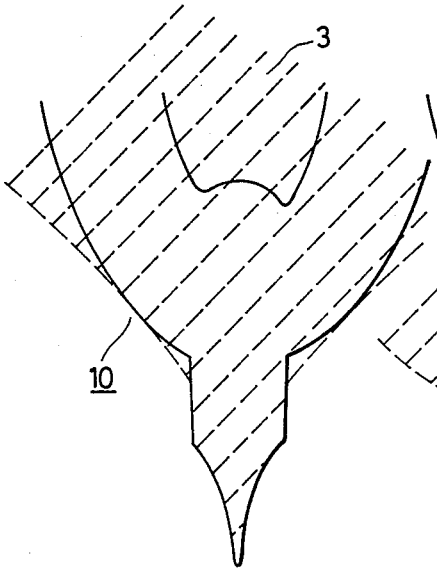
Figure 2D:
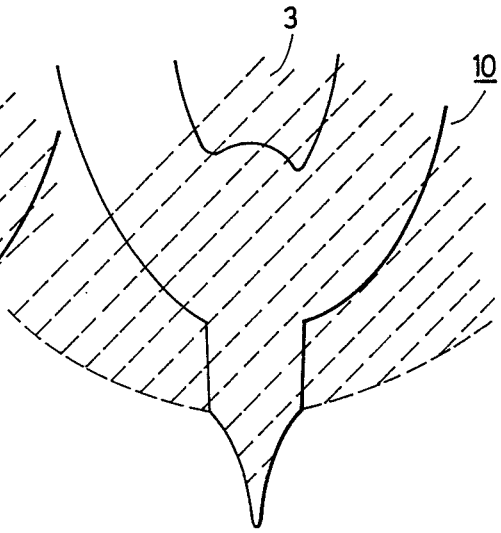
Figure 3:
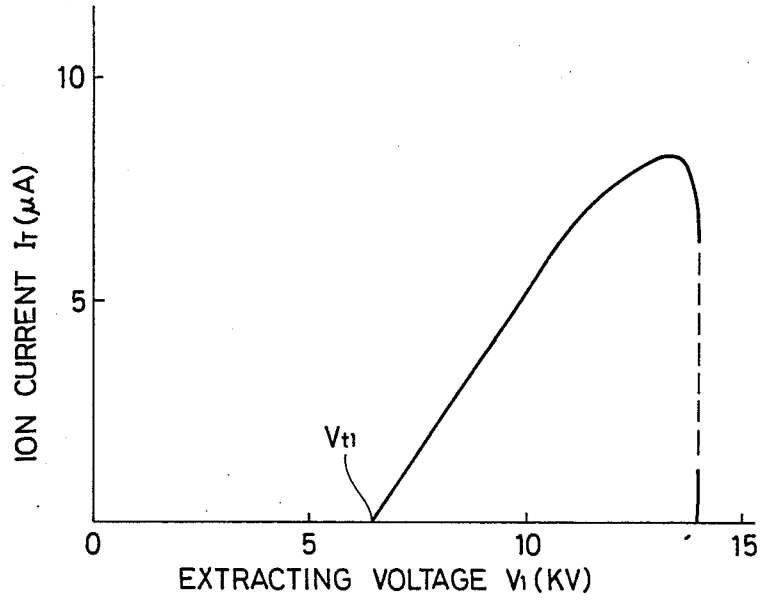
FIG. 3 is a graph which shows the relationship between the extracting voltage and the ion current in the ion source shown in FIG. 1.
Figure 5:
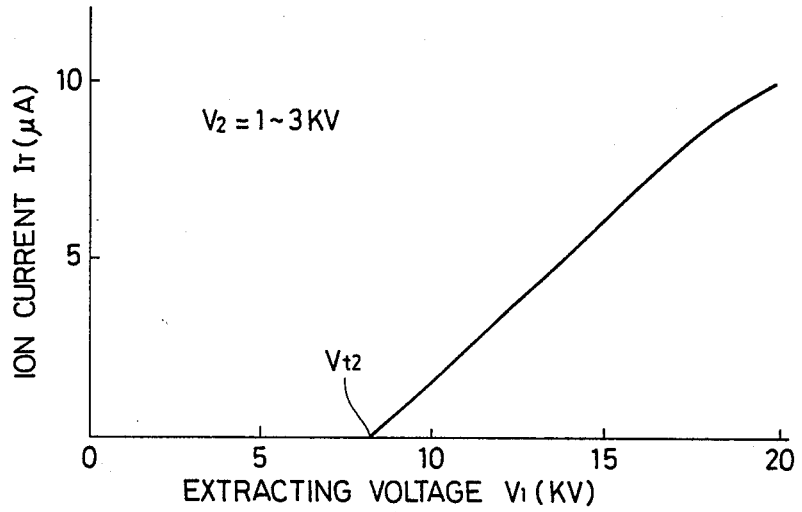
FIG. 5 is a graph which shows the relationship between the extracting voltage (control voltage) and the ion current in the construction of the ion source shown in FIG. 4, and FIGS. 6 and 7 are schematic views of other embodiments of an electrode in the ion source constructed according to the present invention.

In FIG. 5 the ion current $I_T$ was measured by means of an ammeter disposed between the extractor 4 and the ground, with the extractor 4 having no aperture 9. As apparent from FIG. 5, the field intensity established at the pointed end of the tip 2 increases with the increase of the extracting voltage $V_1$, and, at the time when a certain threshold value $V_{t2}$ (approximately 8 kV) is exceeded, the Ga ion beam 5 begins to be emitted from the pointed end of the tip 2. Thereafter, the ion current $I_T$ increases with the increase of the extracting voltage $V_1$ in substantial proportion to the extracting voltage $V_1$. The control voltage $V_2$ at this time lies in a range of 1–3 kV. More specifically, even when the extracting voltage $V_1$ is increased in order to attain a great ion current $I_T$, the electric field to be established by this extracting voltage $V_1$ does not act on the surface of the Ga metal 3 in a part other than the pointed end part of the tip 2 as stated above. Accordingly, the disadvantage as referred to in the description of the prior-art EHD ion source shown in FIG. 1 does not occur, and hence, a large ion current $I_T$ can be obtained. Regarding/the component of the Ga metal 3 wetting the pointed end of the tip 2 as is reduced by the derivation in the form of the Ga ion beam 5 from the pointed end of the tip 2, the Ga metal 3 can be supplied to the pointed end part of the tip 2 in a suitable amount by controlling the control voltage $V_2$. That is, the radius of curvature of the pointed end of the tip 2 in the state in which the end is wetted with the Ga metal 3 is always maintained in the optimum range, and any great change in the field intensity established in the pointed end part of the tip 2 does not develop due to the increase of the radius of curvature. Accordingly, the ion current $I_T$ corresponding to the value of the extracting voltage $V_1$ can be generated from the pointed end of the tip 2 without being limited by the magnitude of the extracting voltage $V_1$. The graph in FIG. 5 obtained under conditions stated below. The electrode 10 used was the same as stated previously. A stainless steel sheet was used as the control electrode 11 with the sheet having an outside diameter of 40 mm aperture 13 of 1 mm, and 0.5 mm a thickness of. The control electrode 11 had its center aligned with the center axis of the tip 2, and was horizontally installed of a position of 0.5 mm from the pointed end of the tip 2 towards the root part of the tip 2. The extractor 4 was installed at position of 2 mm from the pointed end of the tip 2 downwards.

The installed position of the control electrode 11 is not restricted to the above-noted position, but ion sources functioned substantially similarly to the above-stated ion source in the following range. That is, under the state under which the control electrode 11 is held horizontal with the center of the control electrode 11 aligned with the center axis of the tip 2, the permissible distance from the pointed end of the tip 2 onto the root side of the tip 2 is at most 2 mm irrespective of the size of the bore corresponding to the aperture 13. In addition, the permissible distance from the pointed end of the tip 2 onto the side of the extractor 4 is determined by the bore corresponding to the aperture 13, and the range thereof is at most the bore corresponding to the aperture 13.

In the EHD ion source stated above, the optimum surface profile which is to be formed by the Ga metal 3 carried by the holding part 8 of the electrode 10 is the conical shape. In particular, it has been theoretically conjectured by G. Taylor that when the half apical angle of the cone is 49.3°, the stability of the ion current $I_T$ which can be derived is the highest (this cone is called the "Taylor Cone", and is described in detail in Proc. Roy. Soc. (London) A280 (1964) 383 by G. Taylor).

Figure 6:
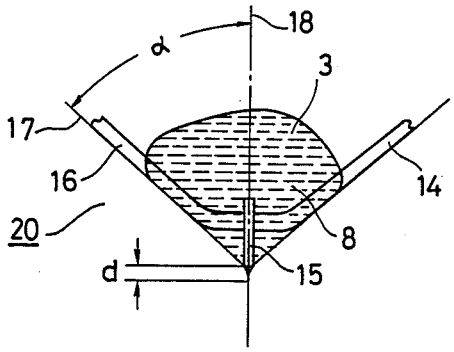

As shown in FIG. 6, on electrode generally designated by the reference numeral 20 is provided which is adapted to enable a formation of the above-noted Taylor cone can be formed between the holding part 8 for the liquefied metal 3 and the pointed end of a tip 15. The tip 15 having a needle-shape pointed end with a diameter of 120 μm, is spot-welded to the central part of a filament 14 which is formed into the conical shape and which has a diameter of 150 μm.

The positional relationship between the filament 14 and the tip 15 is as stated below. The half apical angle α of a cone, formed in such a manner that a tangent 17 to the side line 16 of the filament 14 intersects with the center line 18 of the tip 15, lies in a range of 35°–55°. Moreover, it is desirable that the pointed end of the tip 15 is somewhat protuberant beyond the point at which the tangent 17 to the side line 16 of the filament 14 intersects with the center line 18 of the tip 15, in other words, the apex of the cone, and that the distance of the protuberance d lies in a range of at most 1 mm. By constructing the electrode 20 in this manner, the surface profile of the liquefied metals such as Ga carried on the holding part 8 forms the Taylor cone without fail. As a result, the electrode 20 for example, could reduce the variation-versus-time of the ion current to about 5% from about 30% of the previous electrode in which the positional relationship between the filament and the tip does not meet the relationship specified above. As conditions at this time, Ga was used as the liquefied metals, a voltage of 13 kV was applied as the extracting voltage, and the average value of the ion current was made approximately 8 μA. Here, the "variation-versus-time" signifies the percentage obtained in such a way that a minute variation in the ion current fluctuating in a short time is divided by the average ion current, the quotient being multiplied by 100. The reason why the variation-versus-time could be sharply reduced in comparison with that in the prior art is conjectured as follows.

With the prior-art electrode configuration, even when the Taylor cone is formed by the electric field, it will be unstable and will collapse due to a slight change in conditions. In contrast, the electrode 20 of the present embodiment has the electrode construction in which the Taylor cone is prone to be stably formed, so that the electrode will be capable of stably maintaining the Taylor cone even in case of some changes in the conditions.

Figure 7:
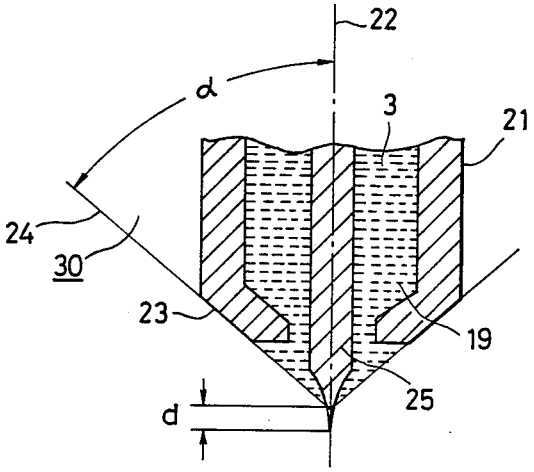

As shown in FIG. 7, an electrode generally designated by the reference numeral 30 is provided Taylor cone which is also adapted to enable a formation of the above-noted between a holding part 19 for the liquefied metal 3 and the pointed end of a needle 25. The electrode 30 includes a pipe 21, made of tungsten or stainless steel, having one end is drawn into the shape of a cone and with an outside diameter of 1 mm and a wall thickness of 0.2 mm, and a needle 25 which is made of tungsten. The needle 25 has a end with pointed a diameter of 500 μm. The pipe 21 and needle 25 are located so that a center line 22 of the needle 25 passes through the center of the pipe 21. Moreover, the pointed end of the needle 25 is slightly protuberant from the conically shaped end of the pipe 21. The positional relation between the pipe 21 and the needle 25 is as stated below. The half apical angle $\alpha$ of the cone, formed in such a manner that a tangent 24 to the side line 23 of the pipe 21 intersects with the center line 22 of the needle 25, lies in a range of 35°-55°. In addition, it is desirable that the pointed end of the needle 25 is somewhat protuberant beyond the point at which the tangent 24 to the side line 23 of the pipe 21 intersects with the center line 22 of the needle 25, in other words, the apex of the cone, and that the distance of the protuberance d lies in a range of at most 1 mm. By constructing the electrode 30 in this manner, the surface profile of the liquefied metals such as Ga carried on the holding part 19 forms the Taylor cone without fail. As a result, the electrode 30 for example, could reduce the variation-versus-time of the ion current to about 5% from about 30% of the previous electrode in which the positional relation between the pipe and the needle does not meet the relation specified above. As conditions at this time, Ga was used as the liquefied metal 3, a voltage of 13 kV was applied as the extracting voltage, and the average value of the ion current was made approximately 8 μA. It has been experimentally revealed that further decreases in the variations-versus-time in the foregoing electrodes 20 and 30 can be achieved by heating the filament 14, the pipe 21 and the needle 25 so as to maintain the liquefied metal 3 at the optimum temperature.

While, in the foregoing embodiments, Ga has been referred to as the liquid substance to be ionized, it has been experimentally verified that metals such as Au, Hg, In and Bi and non-metallic conductive substances can be similarly treated. Of course, they may present liquefied conditions in the states in which ions are derived, and this requisite can be achieved with heating means. While tungsten has been referred to as the constituent material of the electrodes, it is not restrictive, but any other material may well be employed as long as it has a high melting point and it does not cause a chemical reaction with the liquefied substance.

Further, the control voltage $V_2$ need not always be applied so as to afford the negative potential to the control electrode 11, but it may well be applied reversely because the effect of the action of the electric field on the liquefied surface is identical. In this case, however, the direction of the intensity influential on the electric field of the pointed end of the tip 2 becomes the opposite.

As set forth above, according to this invention, it has become possible to use a great extracting voltage to obtain an ion current corresponding to the extracting voltage without being subject to the limitation of the extracting voltage and thus to attain a higher performance of an EHD ion source.

We claim:

1. An ion source comprising a first electrode means having a holding part for holding a substance to-be-ionized maintained in a molten state, and a pointed end part formed in a shape of a needle; a control electrode means disposed in a vicinity of the pointed end part for applying an electric field to the molten substance held by said holding part and for controlling a quantity of the molten substance supplied to the pointed end part by applying an electric field to a liquid surface of the molten substance held by said holding part; and an extractor means disposed opposite to the pointed end part for applying an electric field to the pointed end part wetted with the molten substance and for extracting ions of said molten substance from the pointed end part, said control electrode means shielding the liquid surface of the molten substance on said first electrode means from the electric field generated by said extractor means so that the effect of the field generated by the extractor means on the profile of the liquid surface is reduced thereby ensuring a uniform flow of the molten substance.

2. An ion source as defined in claim 1, wherein said first electrode means includes a hair-pin shaped filament, and a tip terminating in a pointed end part and connected to a central part of said filament.

3. An ion source as defined in claim 2, wherein an angle at which a tangent to a side line of said filament intersects with a center line of said tip lies in a range of 35°-55°, and wherein a distance from the intersection point to said pointed end of said tip does not exceed 1 mm.

4. An ion source comprising a first electrode means formed as a pipe means including a conically shaped end part for holding a substance to-be-ionized in a molten state, and a needle arranged so as to extend through a center of the pipe means such that a pointed end of the needle protrudes beyond the end part of the pipe means; a control electrode means disposed in a vicinity of the end part of the pipe means for applying an electric field to the substance held by the pipe means and for controlling a quantity of the substance supplied to the pointed end of the needle; and an extractor means disposed opposite to the needle for applying an electric field to the pointed end of the needle wetted with the substance and for extracting ions of the substance from the pointed end of the needle; said control electrode means shielding the liquid surface of the molten substance on said first electrode means from the electrode field generated by said extractor means so that the effect of the electric field on the profile of the liquid surface is reduced thereby ensuring a uniform flow of the molten substance.

5. An ion source as defined in claim 4, wherein an angle at which a tangent to a side line of said pointed end part intersects with a center line of said needle lies in a range of 35°-55°, and wherein a distance from the intersection point to said pointed end of said needle does not exceed 1 mm.

6. An ion source as defined in claim 1, wherein said first electrode means further includes heating means for maintaining said molten substance in said molten state.

* * * * *